US005551381A

United States Patent [19]

Lösel et al.

[11] Patent Number: 5,551,381

[45] Date of Patent: Sep. 3, 1996

[54] CONFIGURATION OF A STEAM GENERATOR IN A SUPPORTING STRUCTURE

[75] Inventors: Georg Lösel, Uttenreuth; Werner Kraupa, Fürth; Reiner Engelhardt, Effeltrich, all of Germany

[73] Assignee: Siemens AKtiengesellschaft, Munich, Germany

[21] Appl. No.: 298,567

[22] Filed: Aug. 31, 1994

Related U.S. Application Data

[63] Continuation of PCT/DE93/00163 Feb. 24, 1993

[30] Foreign Application Priority Data

Mar. 3, 1992 [DE] Germany ..... 42 06 657.3

[51] Int. Cl.[6] ..... F22B 37/24

[52] U.S. Cl. ..... 122/510; 122/6 A; 165/81; 165/82; 248/910

[58] Field of Search ..... 122/6 A, 510; 165/81, 82; 248/910

[56] References Cited

U.S. PATENT DOCUMENTS 3,001,514 9/1961 Forsman .
3,159,146 12/1964 Rudolph .
4,510,892 4/1985 Wincze et al. .
4,987,862 1/1991 Wittchow et al. ..... 122/6 A
5,394,837 3/1995 Tsai et al. ..... 122/510

FOREIGN PATENT DOCUMENTS 2806916 8/1979 Germany ..... 122/6 A
1030664 5/1966 United Kingdom .

*Primary Examiner*—Henry A. Bennet
*Assistant Examiner*—Siddharth Ohri
*Attorney, Agent, or Firm*—Herbert L. Lerner; Laurence A. Greenberg

[57] ABSTRACT

A steam generator configuration, in particular of a low temperature carbonization-combustion plant, includes a supporting structure. A flue gas channel is disposed in the supporting structure and has a first vertical segment, a second at least approximately horizontal segment, and a third vertical segment being connected through the second segment to the first segment to form a structural unit. Supporting members suspend the first segment in the supporting structure in order to avoid restrictions to expansion and deformation of the flue gas channel as a result of thermal expansion. The supporting members are in an oblique or slanted position relative to the vertical in a cold condition. The oblique position essentially corresponds to a thermal expansion of the second horizontal segment in a hot condition. The supporting elements are parallel to the vertical in the hot condition. Thus, regardless of the operating state, the flue gas channel remains a structural unit that allows free thermal expansion in the vertical and horizontal directions.

12 Claims, 2 Drawing Sheets

CONFIGURATION OF A STEAM GENERATOR IN A SUPPORTING STRUCTURE

CROSS-REFERENCE TO RELATED APPLICATION

This application is a Continuation of International Application Ser. No. PCT/DE93/00163, filed Feb. 24, 1993.

BACKGROUND OF THE INVENTION

Field of the Invention The invention relates to a configuration of a steam generator, in particular of a low temperature carbonization-combustion plant, including a multi-segment flue gas channel being disposed in a supporting structure and having a first vertical segment connected through a second at least approximately horizontal segment to a third likewise vertical segment, so that the flue gas channel forms a structural unit and the first segment is suspended in the supporting structure by means of supporting members.

With such a steam generator that is known from U.S. Pat. No. 3,001,514, hot flue gases produced in a combustion chamber flow through a flue gas channel which essentially is formed of three segments. The walls of the flue gas channel are equipped with heating surfaces in the form of tubes or tube bundles which are integrated into a water-steam loop. The combustion chamber represents a first vertical segment of the flue gas channel. The combustion chamber is connected through a second, horizontal segment of the flue gas channel to a third segment, which is likewise vertical and opens into a waste heat boiler for steam generation. The water flowing through the heating surfaces serves to cool the combustion chamber and the waste heat boiler, and is at least partly vaporized by means of indirect heat exchange with the hot flue gas. The combustion chamber is fueled with low temperature carbonization gas from a low temperature carbonization plant, for example. A low temperature carbonization-combustion plant is known from European Patent No. 0 302 310, for example.

In order to compensate for restrictions to expansion and deformations of the spatial configuration of the steam generator due to vertical and horizontal thermal expansion, the segments of the flue gas channel, i.e., the heating surfaces of the combustion chamber and the waste heat boiler, are normally structurally separate from one another. Cooling of the combustion chamber takes place by means of forced circulation while the waste heat boiler is cooled by means of natural circulation.

Heretofore, thermal expansion was prevented by structurally separating the heating surfaces of the combustion chamber and those of the waste heat boiler. Cooling of the combustion chamber was carried out by means of forced circulation while the waste heat boiler was cooled by means of natural circulation.

SUMMARY OF THE INVENTION

It is accordingly an object of the invention to provide a configuration of a steam generator in a supporting structure, which overcomes the hereinafore-mentioned disadvantages of the heretofore-known devices of this general type and which provides a flue gas channel formed by heating surfaces of a combustion chamber and of a waste heat boiler as a structural unit which enables free thermal expansion in both vertical and horizontal directions.

With the foregoing and other objects in view there is provided, in accordance with the invention, a steam generator configuration, in particular of a low temperature carbonization-combustion plant, comprising a supporting structure; a flue gas channel being disposed in the supporting structure and having a first vertical segment, a second at least approximately horizontal segment, and a third vertical segment being connected through the second segment to the first segment to form a structural unit; and supporting members suspending the first segment in the supporting structure, the supporting members being in an oblique position relative to the vertical in a cold condition, the oblique position essentially corresponding to a thermal expansion of the second horizontal segment in a hot condition, and the supporting elements being parallel to the vertical in the hot condition.

In accordance with another feature of the invention, the supporting elements are tubes that are at least partly connected with heating surfaces which form walls of the flue gas channel. In this case the tubes are connected together with the heating surfaces in the water-steam loop.

In accordance with a further feature of the invention, there are provided means disposed in the vicinity of the longitudinal axes of the first and third segments for guiding the first segment relative to the third segment of the flue gas channel, whereby the longitudinal axis of the third segment is a fixed axis.

In accordance with an added feature of the invention, the guide means are tubes that are likewise at least partly connected to the heating surfaces which form the walls of the flue gas channel. Through the use of this integration of the guide means into the water-steam loop, the temperature at the guide means is always the same as the temperature of the heating surfaces in the second segment of the flue gas channel. As a result, the longitudinal axes of the first and third segments of the flue gas channel are always parallel, even in the event of different degrees of horizontal thermal expansion.

In accordance with an additional feature of the invention, the first segment of the flue gas channel is disposed in a first supporting grate, which is connected to a second supporting grate above the flue gas channel by means of the supporting elements and to a third supporting grate below the flue gas channel by means of at least one connecting element. The flue gas channel rests against the third supporting grate which is hung from the second supporting grate.

In accordance with yet another feature of the invention, the first supporting grate is constructed as a frame which encloses the first segment of the flue gas channel.

In accordance with yet a further feature of the invention, the third segment is suspended from the second supporting grate by means of additional supporting members.

In accordance with yet an added feature of the invention, alternatively, the third supporting grate is connected to the second supporting grate by means of at least one additional connecting element.

In accordance with yet an additional feature of the invention, the connecting elements and/or the additional supporting members are tubes connected to the heating surfaces.

The advantages gained by means of the invention are, in particular, the fact that despite the inevitable horizontal and vertical thermal expansion in the hot condition, the spatial configuration of the flue gas channel is always the same. Identical vertical expansion occurs in all segments and planes at the same height, while the longitudinal axes of the first and third segments always undergo common and parallel horizontal heat expansion.

Other features which are considered as characteristic for the invention are set forth in the appended claims.

Although the invention is illustrated and described herein as embodied in a configuration of a steam generator in a supporting structure, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

Figure 1:
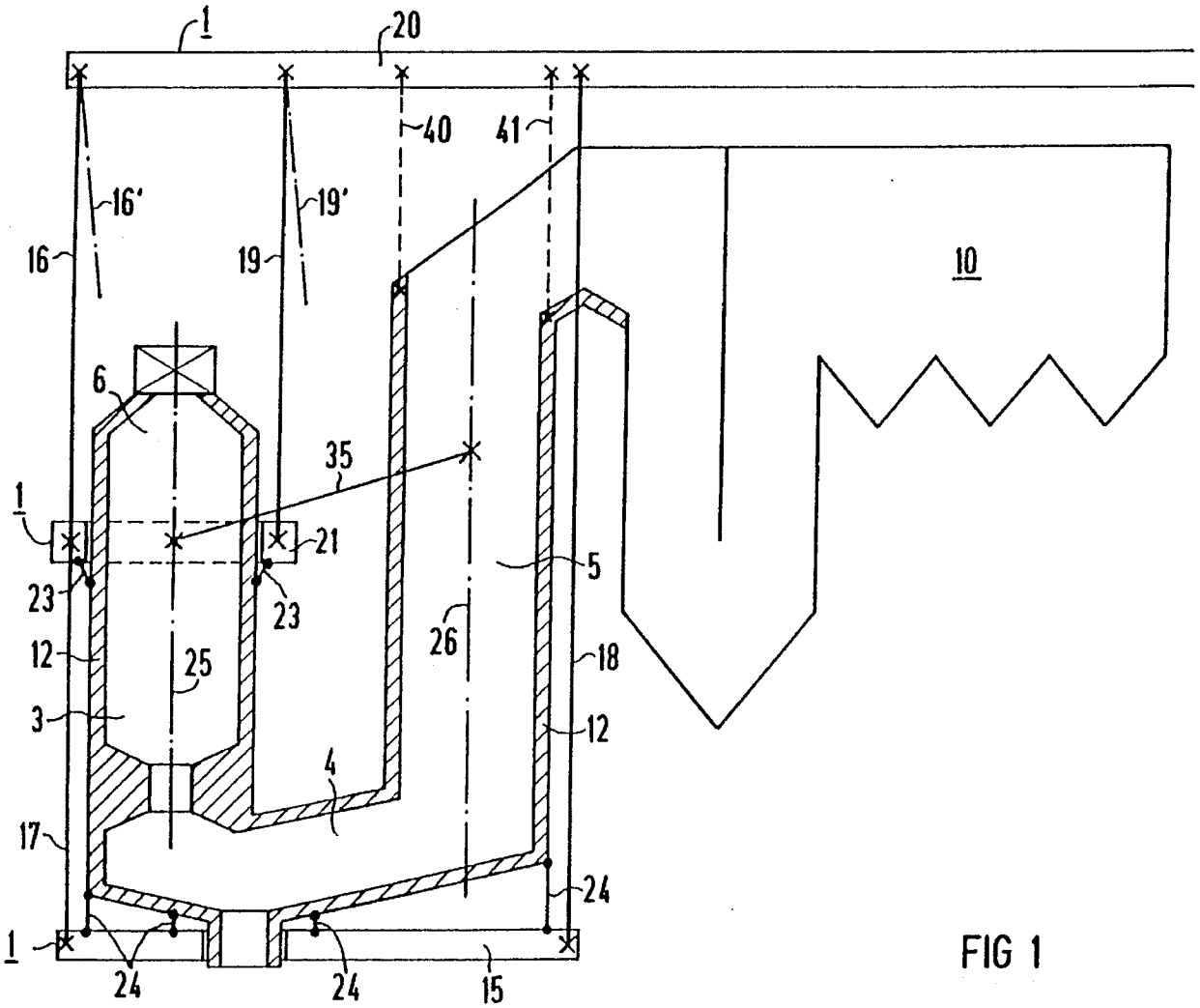
FIG. 1 is a diagrammatic, partly sectional view of a low temperature carbonization-combustion plant steam generator placed in a supporting structure.

Referring now in detail to the figures of the drawing, in which corresponding parts are indicated with the same reference numerals, and first, particularly, to FIG. 1 thereof, there is seen a placement of a steam generator in a supporting structure 1. The steam generator is part of a non-illustrated low temperature carbonization-combustion plant. The steam generator includes a flue gas channel being formed of first, second and third segments 3, 4 and 5. The first segment 3 is essentially formed by a combustion chamber 6 and is oriented vertically. The first segment 3 is connected through the second, nearly horizontal segment 4 to a third, likewise vertical segment 5 that opens into a waste heat boiler 10. Located in the waste heat boiler 10 are non-illustrated heating surfaces for the generation of steam.

The flue gas channel formed of the segments 3, 4 and 5 is suspended in the supporting structure 1. To this end, it rests against a bottom supporting grate 15. This grate 15 is connected through connecting elements 17 and 18 and at least one supporting member 16 to an upper supporting grate 20. Additionally, the first segment 3 of the flue gas channel is guided by a supporting grate 21, which is hung from the top supporting grate 20 by means of supporting members 16 and 19. Supporting members 40, 41 (represented by dotted lines), with which the segment 5 can be hung directly from the upper supporting grate 20, can also be used in place of the connecting element 18.

The flue gas channel is essentially delimited by heating surfaces 12, which are usually constructed as tubes or tube bundles and are integrated into its walls. The heating surfaces 12 of the segments 3, 4, and 5 are interconnected so that the flue gas channel forms a structural unit. The heating surfaces 12 are connected in a non-illustrated manner to a water-steam loop, and water or a water-steam mixture flows through them by means of natural circulation. It is advantageous for the connecting elements 17 and 18 as well as the supporting members 16, 19, 40 and 41 to be tubes that are integrated into the natural circulation system of the water-steam loop.

Instead of a heating surface through which water or water vapor flows, a portion of the height of the segment 5 can also be equipped with a non-illustrated air-cooled lining. The water-cooled and air-cooled heating surfaces are then gas-tightly connected to one another in a non-illustrated manner by means of a compensator.

Below the supporting grate 21 are pendulum suspensions 23 that are connected to the first segment 3 of the flue gas channel. Below the second segment 4 of the flue gas channel are supports 24 that are connected to the supporting grate 15.

As is indicated by dotted lines 16' and 19' in FIG. 1, the supporting members 16 and 19 are oblique or slanted in relation to the vertical and assume positions 16' and 19' in a cold condition, i.e. before start-up of the steam generator. The oblique or slanted position is due to the fact that the flue gas channel or boiler body is contracted relative to the hot condition. The inclination essentially corresponds to the thermal expansion of the second segment 4 in the hot condition, i.e., during operation of the steam generator. This ensures that two longitudinal axes 25 and 26 are parallel in the hot condition.

Due to the shift of the supporting members 16, 19 to the respective positions 16' and 19', a force component occurs in the segment 3, which also forces this segment 3 into an oblique or slanted position. In order to prevent this, it is advantageous to place guides 35 in the vicinity of the longitudinal axes 25 and 26 of the respective segments 3 and 5. The guides 35 are advantageously integrated into the tubes connected to the heating surfaces 12 of the two segments 3 and 5 and thus are also integrated into the natural circulation system. Thus the guides have the same temperature as the heating surfaces 12 of the second segment 4 of the flue gas channel.

Figure 2:
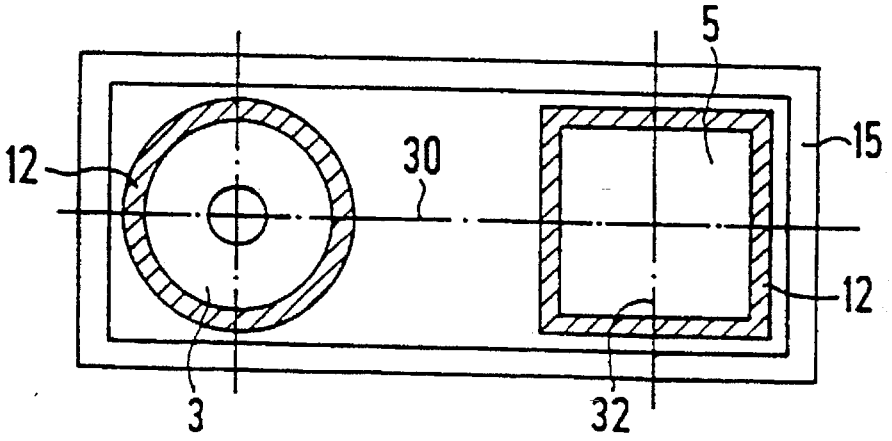
FIG. 2 is a cross-sectional view of two segments of a flue gas channel of a steam generator as shown in FIG. 1.

When the steam generator is in operation, a plane defined by the longitudinal axes 25 and 26 remains a fixed plane 30, independent of thermal expansion. In FIG. 2, this plane is perpendicular to the plane of the drawing. A plane 32 which is perpendicular to this fixed plane 30 and in which the longitudinal axis lies, also remains a fixed plane. In this way, the structural unit of the flue gas channel is maintained in the event of vertical as well as horizontal thermal expansion.

Figure 3:
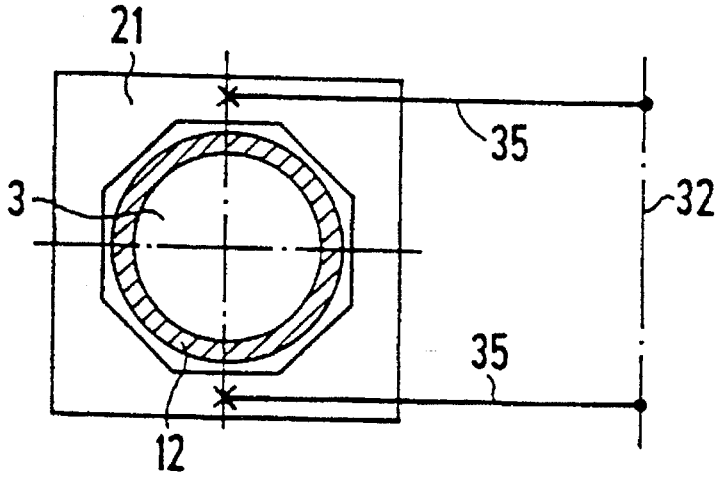
FIG. 3 is another cross-sectional view showing guides between two vertical segments of the flue gas channel as shown in FIG. 1.

As FIG. 3 shows, the guides 35 can also easily be constructed as tie rods and connected to the supporting grate 21 in the vicinity of the first segment 3 of the flue gas channel. The supporting grate 21 thereby surrounds the first segment 3 in the form of a frame.

We claim:

1. A steam generator configuration, comprising:

a supporting structure;

a flue gas channel being disposed in said supporting structure and having a first vertical segment, a second at least approximately horizontal segment, and a third vertical segment being connected through said second segment to said first segment to form a structural unit; and supporting members suspending said first segment in said supporting structure, said supporting members being in an oblique position relative to the vertical in a cold condition, said oblique position essentially corresponding to a thermal expansion of said second horizontal segment in a hot condition, and said supporting elements being parallel to the vertical in the hot condition.

2. The configuration according to claim 1, wherein said flue gas channel has walls formed by heating surfaces, and said supporting members are tubes being at least partly connected to said heating surfaces.

3. The configuration according to claim 1, wherein said first and third segments have respective longitudinal axes, and including means in the vicinity of said longitudinal axes for guiding said first segment relative to said third segment, said longitudinal axis of said third segment being a fixed axis.

4. The configuration according to claim 3, wherein said flue gas channel has walls formed by heating surfaces, and said guiding means are tubes being at least partly connected to said heating surfaces.

5. The configuration according to claim 1, including:

a first supporting grate in which said first segment of said flue gas channel is disposed;

a second supporting grate being disposed above said flue gas channel and being connected to said first supporting grate by said supporting members;

at least one connecting element; and a third supporting grate against which said flue gas channel rests, said third supporting grate being disposed below said flue gas channel and being hung from said second supporting grate and connected to said first supporting grate by said at least one connecting element.

6. The configuration according to claim 5, wherein said first supporting grate is constructed as a frame and surrounds said first segment.

7. The configuration according to claim 5, including further supporting members hanging said third segment from said second supporting grate.

8. The configuration according to claim 5, including at least one further connecting element connecting said third supporting grate to said second supporting grate.

9. The configuration according to claim 5, wherein said flue gas channel has walls formed by heating surfaces, and said at least one connecting element is at least one tube connected to said heating surfaces.

10. The configuration according to claim 8, wherein said flue gas channel has walls formed by heating surfaces, and said further connecting element is a tube connected to said heating surfaces.

11. The configuration according to claim 7, wherein said flue gas channel has walls formed by heating surfaces, and said further supporting members are tubes connected to said heating surfaces.

12. A steam generator configuration of a low temperature carbonization-combustion plant, comprising:

a supporting structure;

a flue gas channel being disposed in said supporting structure and having a first vertical segment, a second at least approximately horizontal segment, and a third vertical segment being connected through said second segment to said first segment to form a structural unit; and supporting members suspending said first segment in said supporting structure, said supporting members being in an oblique position relative to the vertical in a cold condition, said oblique position essentially corresponding to a thermal expansion of said second horizontal segment in a hot condition, and said supporting elements being parallel to the vertical in the hot condition.

* * * * *